United States Patent [19]

Dismukes

[11] 4,303,134

[45] Dec. 1, 1981

[54] EARTH BORING GUIDE

[76] Inventor: Newton B. Dismukes, 2952 Buttonwood Dr., Carrollton, Tex. 75006

[21] Appl. No.: 171,801

[22] Filed: Jul. 24, 1980

Related U.S. Application Data

[63] Continuation-in-part of Ser. No. 948,085, Oct. 2, 1978.

[51] Int. Cl.[3] ..... E21B 7/08

[52] U.S. Cl. ..... 175/61; 175/75; 175/78; 175/80

[58] Field of Search ..... 175/61, 73–75, 175/77–82, 256, 274

[56] References Cited

U.S. PATENT DOCUMENTS

| | | | |
|---|---|---|---|
| 1,660,999 | 2/1928 | MacDonell | 175/79 |
| 2,410,753 | 11/1946 | Shinomiya | 175/82 |
| 3,903,974 | 9/1975 | Cullen | 175/73 |
| 4,007,797 | 2/1977 | Jeter | 175/81 |

*Primary Examiner*—William F. Pate, III

*Attorney, Agent, or Firm*—Sidney A. Johnson

[57] ABSTRACT

The invention provides a guide means for deflecting drilling means at a desired location in a well bore to enable the drilling of either a sharply deviated extension thereof or a lateral branch bore. A frame carrying spaced drill tubing holding members is lowered along with the drill bit and tubing into the well bore. Latch means, operable from the surface, release spring members which act to deflect the lower tubing holding member, the tubing and drill bit into the desired orientation. The latch means may be reset from the surface, realigning the tubing holding members so that the guide means assembly may be readily withdrawn from the well bore.

10 Claims, 9 Drawing Figures

EARTH BORING GUIDE

RELATED APPLICATIONS

This application is a continuation-in-part of application Ser. No. 948,085, filed Oct. 2, 1978. The invention forming the subject matter of this application is especially useful with the Method and Apparatus for Forming Lateral Passageways forming the subject matter of my application Ser. No. 06/125,240 filed Feb. 27, 1980.

BACKGROUND OF THE INVENTION

1. Field of the Invention

The present invention relates to a system for forming either a lateral passageway at a desired location in a well bore or for forming a sharply curved continuation thereof. The invention provides a guide apparatus which may be introduced into the well bore along with the drilling means and which, at the desired level, may be activated from the surface to deflect the drilling means in the desired direction.

2. Description of the Prior Art

Current oil field practice in drilling deviated full diameter wells, that is wells formed by the largest diameter bit that will pass through the last string of casing set, is to develop deviation angle at a rate of a few degrees per 100 feet of new hole. Rarely, angle increase may reach 7 to 9 degrees per 100 feet. Because sharply curving well bores may be formed with the instant apparatus and appropriate boring tools it is more convenient to relate change in angle to the number of hole diameters drilled. Thus, a buildup angle of 10 degrees per 100 feet in a 8.25-inch hole is the same as one degree per 14.5 diameters. The instant invention contemplates well curvatures of the order of magnitude of 2 to 8 times the minimum bending radius of the flexible shaft. For example, the manufacturer of a 4-inch inside diameter hose having a theoretical burst pressure of 4,000 pounds per square inch recommends a minimum bending radius of 16 inches for that hose. Such hose may be used in forming an 8.25-inch diameter lateral bore which curves 90 degrees in 6 diameters, or 15 degrees per well diameter. The boring tool preferably is self-advancing and must be able to penetrate the earth when deflected laterally by the guide. Boring means described above are the subject of my copending application Ser. No. 06/125,240 filed Feb. 27, 1980.

U.S. Pat. No. 1,660,999, MacDonnell, describes an apparatus having a laterally deflectable guide portion and a flexible shaft with a drill bit at its lower end. The device requires an anchor pipe to the well bottom and an under reamed well section and is not capable of forming a full diameter bore hole.

In the field of solution mining Cross, U.S. Pat. No. 2,251,916, shows a curved roller and cable guidance system for directing a small diameter, solvent carrying hose, which may include an advancing means and a turbo-cutter. The system appears incapable of forming a full diameter, curved bore hole, although a large cavity may be made in a sufficiently soluble stratum.

U.S. Pat. No. 2,271,005, Grebe, combines solvent and boring apparatus to form a passageway from a vertical well. While several orienting and hose bending guides are illustrated, it is clear that the system is unable to form a full diameter, lateral bore hole.

U.S. Pat. No. 2,516,383, Hays, shows a hose turner having an endless belt and a curved passageway with flanged rollers for extending a conduit outwardly from a first well to drill a lateral bore hole. The apparatus is unable to form a full diameter bore and is too complicated for practical usage.

The drilling means of Robertson, U.S. Pat. No. 2,516,421, includes an electrically powered drive system for bending a flexible shaft. The length of lateral hole which can be formed by the Robertson device is quite limited since no means of re-entry is shown. Also, a full diameter lateral bore is not possible with this device.

U.S. Pat. No. 2,822,158, Brinton, discloses a method of fluid mining including a shaft bendable in one plane but not in a plane normal thereto. A boring device is shown to carom off a rounded top of a post which is claimed to act as a deflector to cause a horizontal and even an upwardly trending bore to be drilled. The method is limited to a very special condition of earth stratification rarely, if ever, found in real life. No means for orienting a boring tool is disclosed.

U.S. Pat. No. 3,402,965, Dahms et al, describes an improved method of solution mining including an orientation means and a floating solvent delivery hose which extends itself by internal fluid friction to convey a solvent to the nether reaches of a solution cavity. Boring is not disclosed and the system appears incapable of adaptation to a boring operation.

U.S. Pat. No. 3,402,967, Edmonds et al, relates to a solution mining apparatus employing a nest of tubes to be extended at right angle to a bore hole. Because the nest of tubes requires a cavity in order to be extended, the apparatus is unsuited to boring.

J. A. Zublin in U.S. Pat. Nos. 2,336,334 and 2,382,933 shows systems for drilling deviated holes using a specially designed slotted section of drill pipe just above the bit. The slotted section is so constructed as to normally assume a curved position but is held straight while being lowered into the well bore by a rigid internal rod. Once deviation is attained, the Zublin device must be removed from the hole before further drilling can proceed with attendant hazards of stuck drill pipe.

Other devices for deflecting a drilling bit are shown by S. Shinomiya, U.S. Pat. No. 2,410,753; Roy Cullen, U.S. Pat. No. 3,903,974; and John D. Jeter in U.S. Pat. Nos. 3,893,523 and 4,007,797. Shinomiya proposes to deviate the flexible pipe section at the end of his drill string by pulling on a cable from the surface. The practicality of such a scheme is questionable. As shown his device seems intended to produce an enlarged section, similar to underreaming, at the bottom of a bore hole. Cullen and Jeter are generally similar to Zublin in that they propose the use of specially designed sections to be inserted in the drill string just above the bit to attain the desired deflection of the bit.

SUMMARY OF THE INVENTION

The invention comprises a system for deviating a drilling means in a desired direction and amount at a chosen point in a well bore. The deviation may be initiated at the bottom of the well bore to form a curved extension thereof or at any intermediate level to form a lateral branch bore. A conventional type of drilling bit may be employed at the end of a flexible form of drill pipe or tubing. The upper portion of the drill pipe or tubing which will not be expected to pass into the deviated hole may be conventional. Since the portion of the drill pipe or tubing adjacent the drilling bit must be flexible, power to rotate the bit is preferably derived from the drilling fluid circulating through the drill pipe. A bottom hole turbine may be used or the bit may be rotated by the reactive forces generated by the discharge of drilling fluid through appropriately positioned nozzles on the drilling bit as shown in my copending application Ser. No. 06/125,240. If desired, the flexible drill pipe or tubing may also be rotated, for example, to minimize the risks of differential pressure sticking.

Essentially, my invention contemplates the provision of spaced upper and lower members for holding the flexible drill pipe interconnected by normally curved resilient members, typically stressed elastic, normally curved steel bars. The upper ends of the steel bars and the upper drill pipe holding members are fixed to a frame which extends downwardly to the vicinity of the lower drill pipe holding members and carried means, typically steel wires, for restraining the lower ends of the curved resilient members into a generally straightened position and axially aligning the upper and lower drill pipe holding members. By axial alignment I mean that, assuming the pipe holding members to be ring shaped, the rings would all have a common principal axis. Release of the restraining means allows the curved resilient members to assume their normal position, at least in part, displacing the lower drill pipe holding member and forcing the drilling means into contact with the bore hole wall. The amount and rate of stress release is controllable from the surface by means of a wire line system which also enables the resilient members to be again restrained while at depth for ready withdrawal of the system to the surface.

DESCRIPTION OF THE PREFERRED EMBODIMENT

Figure 3:
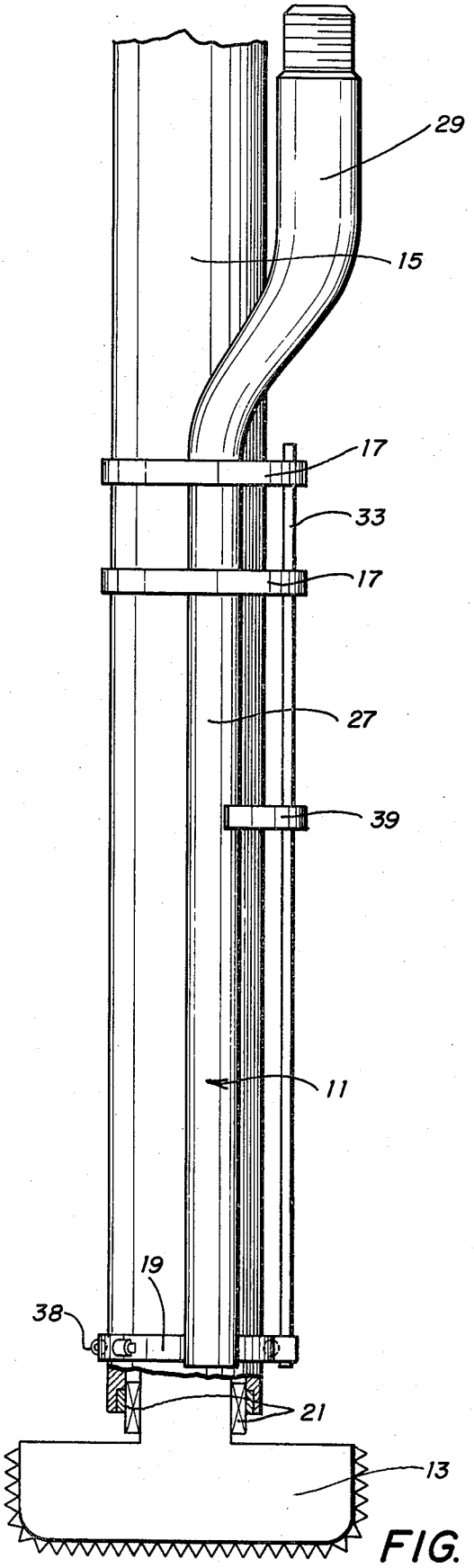
FIG. 3 is a vertical view of the shaft bending guide with the bit and flexible conduit held in the restrained position.

As shown in FIG. 3 the guide means indicated generally by the numeral 11, drilling bit 13 and flexible shaft conduit 15 are assembled at the surface. The resilient means are held in the straightened position as described later so that the upper conduit holding members or bands 17 and lower conduit holding member or band 19 are in substantial axial alignment. The flexible conduit is then passed through the upper and lower conduit holding members and the rotary bit is attached to the bottom end of the conduit by rotating union or bearing 21, since in the preferred form the conduit is nonrotating.

As shown, the upper conduit holding members or bands are in the general form of elliptical steel bands and the lower conduit holding member is in the form of a ring. The specific shape of the bands is not critical so long as they will encircle the flexible conduit to a sufficient extent to control its position. For example, the upper bands might also have a ring shape, in which event instead of being directly fastened to the frame of the guide means as shown, brackets or other fastening means would be employed to join the bands to the guide frame.

Figure 1:
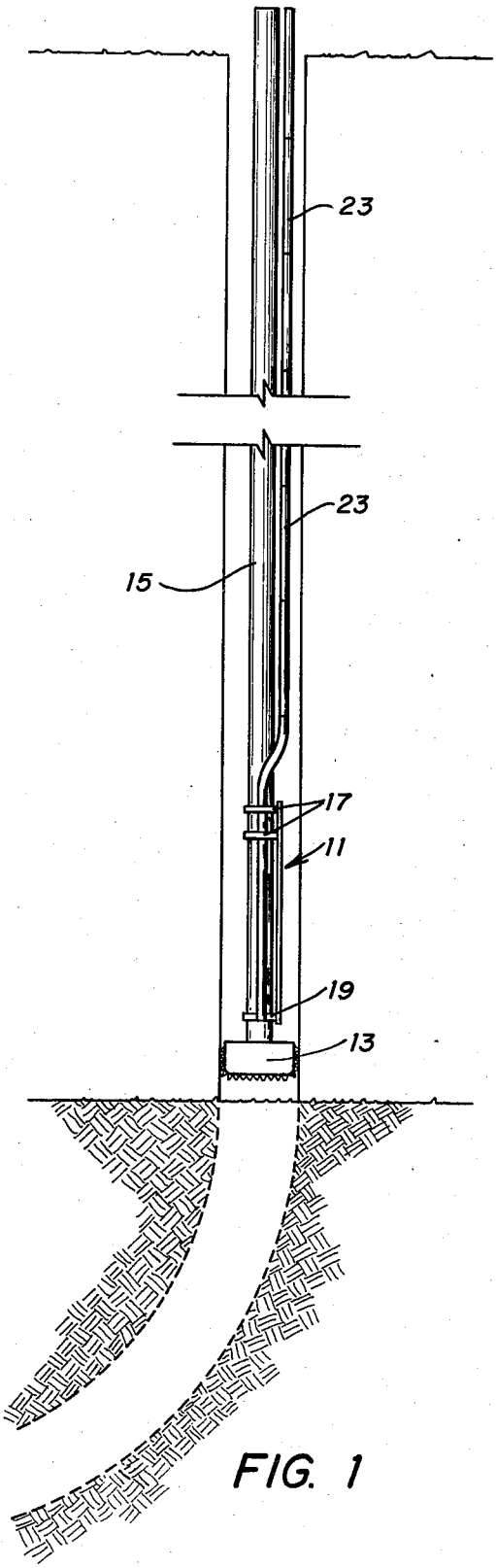
FIG. 1 is a cross-sectional view of a well bore illustrating the shaft bending guide in position in the well bore with the drill bit and flexible conduit held in the restrained position just above the formation wherein the well is to be deviated as indicated in phantom.

The guide and drilling bit assembly is then ready to be lowered into the well as shown in FIG. 1.

Sections of tubing 23 are successively added to the string of tubing 15 as the guide means is lowered into the well bore and flexible tubing is reeled out until the bit has been lowered to the level where it is desired to commence the deviated hole.

Figure 2:
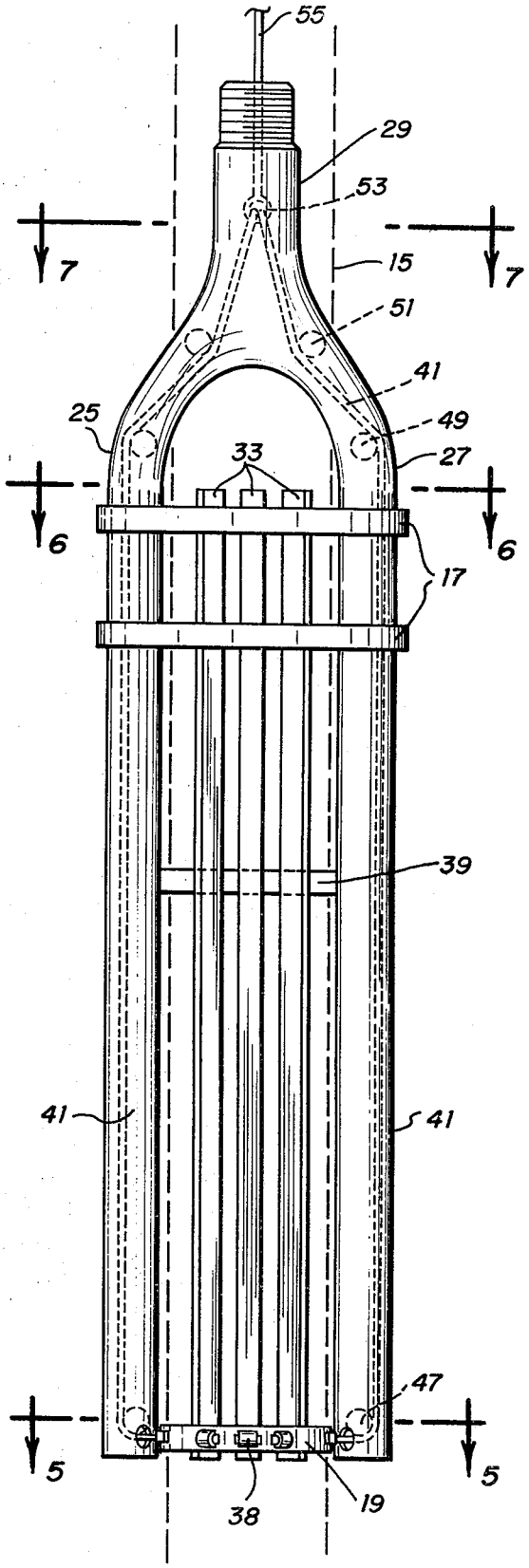
FIG. 2 is a front view of the shaft bending portion of the guide showing the resilient members in their restrained position.
Figure 4:
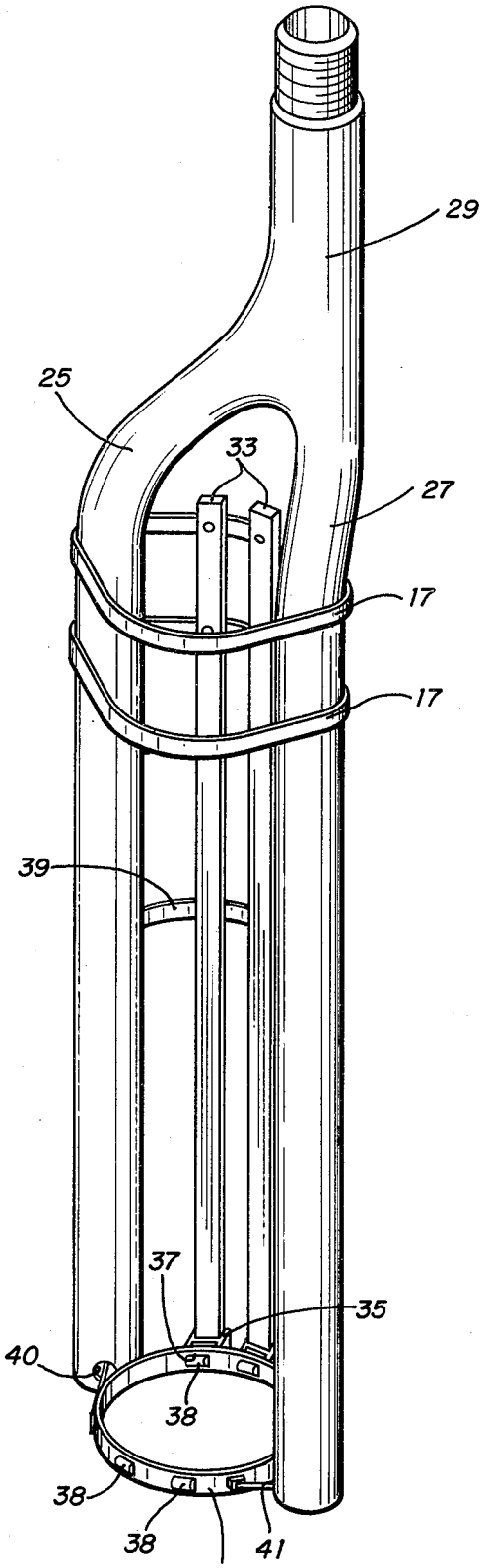
FIG. 4 is a perspective view of the shaft bending position of the guide.
Figure 9:
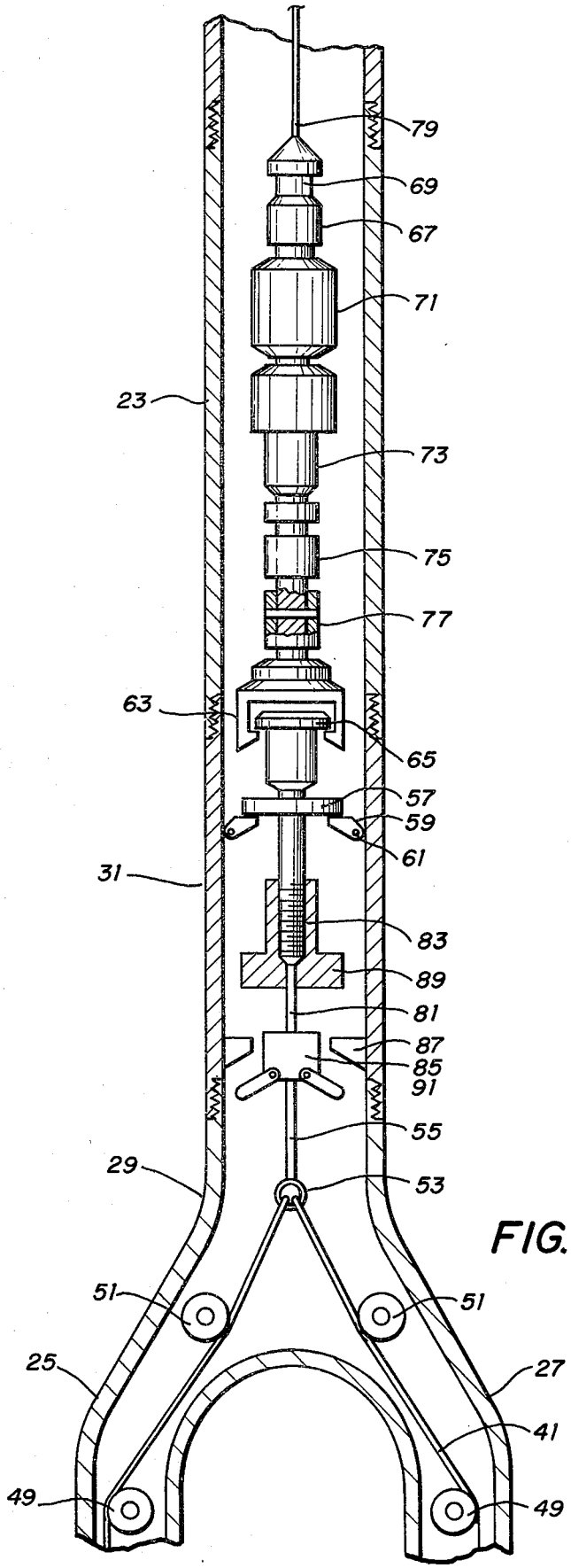
FIG. 9 is a vertical view, partly in section, showing the upper neck portion of the guide with the latching means and the connecting tubing structure for lowering the guide with the overshot connected to manipulate the guide.

The guide means 11, the lower portion of which is shown in detail in FIGS. 2 and 3, and in perspective in FIG. 4, comprises a main frame member in the form of an inverted wye, with legs 25 and 27 and a neck portion 29 made of hollow steel tubing. The neck portion preferably is constructed in two segments, threadedly connected for each in fabrication and to permit ready servicing and adjustment of the latching mechanism as described later. The upper end of the neck portion 31, FIG. 9, is externally threaded for connection to the lowermost tubing section 23. The neck portion is also offset from the legs of the frame so that the tubing members 23 will extend upwardly parallel to the flexible conduit and so that the frame may be oriented from the surface by twisting the tubing.

The upper conduit holding members 17 are welded to legs 25 and 27 of the frame and are of a size and shape to encircle conduit 15. Preferably, at least two bands, as shown, are used to minimize any tendency of the resilient member to bow out when it is restrained. The upper ends of the resilient members 33 are welded to the upper conduit holding bands. A plurality of resilient members, three are shown, preferably are used to give better directional control to the deflection of the conduit when the resilient members are released.

As shown the resilient members are directly welded to the upper conduit holding bands. Since the only requirement, however, is that the resilient members and the upper conduit holding members maintain the same relative position, each might be separately welded to the frame or to support brackets carried by the frame, so that they would be indirectly rather than directly connected.

Lower conduit holder band 19 is not fixed to the legs of the wye and is generally circular in shape to encircle the shaft conduit. Brackets 35 adapted to receive the lower ends of the resilient members are welded to the lower conduit holder and slid over the ends of the resilient members and fastened thereto. The lower conduit holder is provided with slotted openings 37 around the periphery thereof into which are inserted rollers 38 to ease relative motion between the shaft conduit and the lower conduit holder.

One or more braces 39 may be welded to the back side of the wye frame intermediate the upper conduit holders and the bottom end thereof to aid in restraining the resilient members into a generally straight position.

Figure 5:
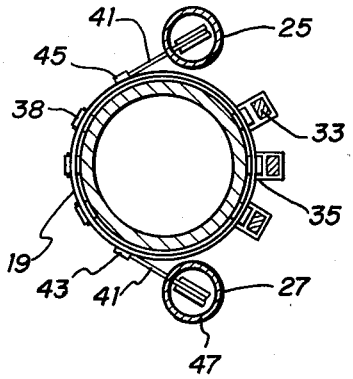
FIGS. 5, 6, and 7 are horizontal cross-sectional views of the guide taken at lines 5—5, 6—6, and 7—7, respectively, of FIG. 2.
Figure 6:
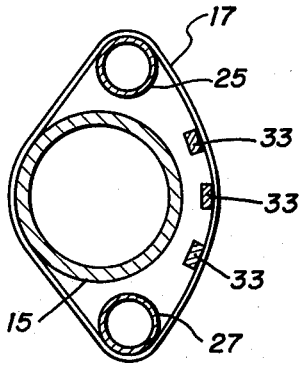
Figure 7:
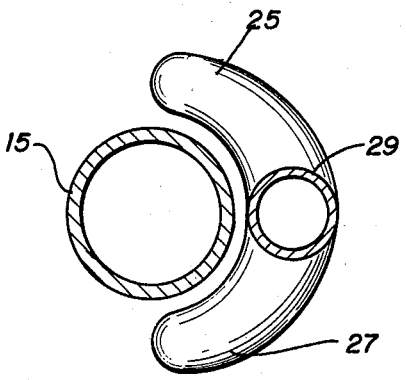
Figure 8:
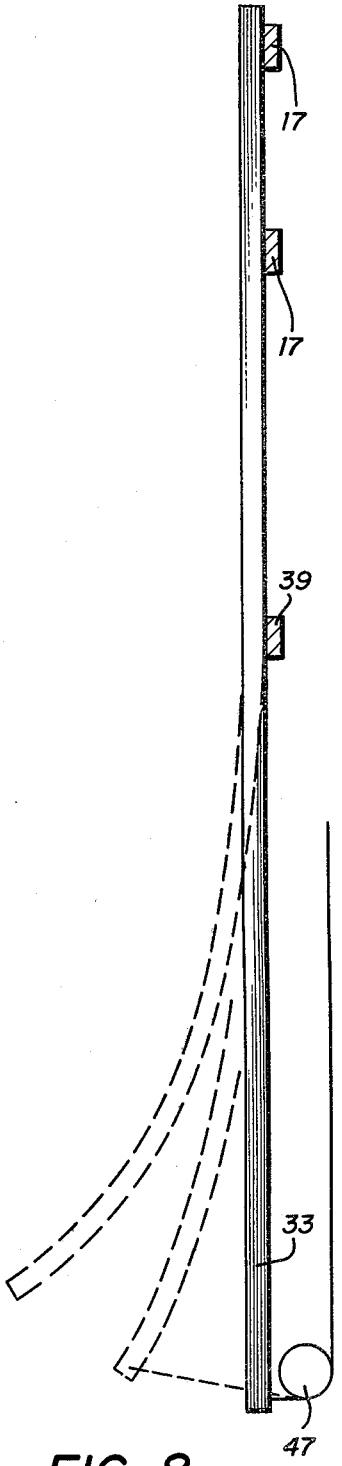
FIG. 8 illustrates the effect of releasing the restraining means on the resilient members of the guide showing how the bit and flexible conduit thereabove are deflected.

Openings 40, facing inwardly as shown in FIGS. 2 and 4, are drilled into the lower ends of the hollow legs to the wye. Steel control lines 41, the operation of which is described below, emerge from the hollow legs of the wye through holes 40 and are fastened to the lower conduit holder as shown at 43 and 45, FIG. 5.

Lower pulleys 47, intermediate pulleys 49 and upper pulleys 51, within the hollow legs of the wye guide the control lines and facilitate their movement between lower conduit holder and the ring connection 53 on the lower end of latch connecting rod 55.

As shown in FIG. 9, latch connecting rod 55 controls the tension on control lines 41 and hence the position of the lower conduit holding member. Initially, the rod 55 is pulled into its upper position as shown in FIG. 9 to put tension on the control lines and pull the lower conduit holding member into the position shown in FIGS. 3 and 4, straightening the resilient members. Rod 55 is held in position by means of upper stop 57 which is prevented from moving downwardly by spring loaded latch 59 mounted by pins 61 on the upper neck tubing section 31.

When it is desired to release tension on the control lines, stop 57 is raised by lowering into the well overshot latch means 63 to engage fishing head 65. The overshot latch is lowered on a conventional wire line system comprising wire line socket 67, fishing neck 69, stem 71, jar section 73, knuckle joint 75 and shear pin 77.

In operation the wire line 79 is lowered from the surface until the overshot latch means engages the fishing head 65. Tension is then applied to line 79 lifting upper stop 57 off latch 59 simultaneously raising connecting rod 81, turnbuckle 83, and lower latch block 85. The wire line is not lifted to such an extent that the lower latch 85 is lifted through lower stop block 87 at this stage. The turn-buckle may be used to adjust the length of the connection rod as necessary to space stop 89 above the lower stop block to prevent the resilient members 33 from bending beyond the desired angle of deviation of the well bore. Since upper neck tubing is removable, the length of rod 81 and hence the degree of deviation may be readily adjusted by the turnbuckle.

When the extension boring is completed, additional tension may be applied to the overshot wire line to restraighten the resilient members and to pull lower latch block 85 completely through the lower stop block 87 whereupon lower latch 91 prevents descent of latch connecting rod 55 holding the conduit and conduit holding means in the straightened condition when the overshot unit is pulled after shearing 77 by means of jars 73.

A spring may be included in the lower portion of latch connecting rod 55 to increase the elasticity of the assembly and to insure proper positioning of latch block 85 if the natural elasticity of the various elements is not sufficient.

After pulling the overshot unit from the well, the guide assembly may be removed from the well by lifting the tubing sections 23 and simultaneously the flexible shaft conduit.

The range of buildup angle of a full diameter, arcuate extension of a first well when employing the instant invention, while large, is not unlimited. Low rates of angle buildup are not practical because a stressed, normally curved member would have to be so long that it could not exert sufficient lateral deflecting force on a boring tool. Also, while it is entirely feasible to lower the orienting and guide means while drilling ahead, existing directional drilling technology is more efficient in forming gently deviated bore holes. Thus, the present apparatus is neither practical nor efficient for forming bore hole extensions which deviate at a rate of less than about 5 degrees per tool diameter of depth. The upper limit of rate of angle buildup is determined by the effective minimum bending radius of the flexible conduit shaft. Even though the physical minimum bending radius is not exceeded the shaft cannot be so stiff, have so large a tensile modulus, that it offers excessive resistance to being bent. Also, since boring tools usually are not flexible, buildup angle must be gentle enough to accommodate the tool.

Examination of a number of commercially available hoses reveals that in general the minimum bending radius increases with increasing diameter and stiffness increases with increasing burst strength. The dimensionless ratio of physical minimum bending radius to hose outside diameter for hoses having a burst pressure between 400 and 10,000 pounds per square inch is between 2.5 and 11 with 5.2 being the average. Considering that the diameter of a boring tool ordinarily is in the range of twice the shaft or hose outside diameter, the ratio hose minimum bending radius/tool diameter for the hoses examined becomes 1.25 to 5.5 with an average of 2.6. Further, internal fluid pressure increases hose stiffness. These factors lead to a dimensionless ratio of 2 being about the practical limit. In other words, a 90-degree, full diameter, curved bore hole extension may be achieved in a distance of 2 boring tool diameters for an average buildup angle of 45 degrees per tool diameter using the instant invention.

Angle buildup is expressed herein in terms of boring tool diameter rather than bore hole diameter because the latter often is uncertain due to sloughing of walls or washouts. The novel apparatus disclosed herein is most practical and useful when forming a full diameter extension of a first well at an angle buildup rate between 5 and 45 degrees per boring tool diameter. It should be understood, however, that smaller diameter extensions may be formed at essentially a right angle to the first bore axis when boring means and the positioning and guiding apparatus are small enough to form a right angle while remaining inside the walls of said first well. The deflecting force of the stressed members causes the apparatus to move toward the bore hole wall opposite the wall to be penetrated by the boring tool thus making available the entire cross-sectional area of the first well for the purpose of bending the boring means.

Since many variations from and embodiments of the apparatus of this invention are within the scope thereof, it is to be understood that all matter set forth herein or shown in the accompanying drawings is to be interpreted as illustrative and not in a limiting sense.

What is claimed is:

1. Guide means for changing the direction of advance in a bore hole of a boring tool comprising a rotary bit affixed to a flexible conduit for conducting drilling fluid thereto comprising:

a. a frame, b. spaced upper and lower conduit holding members, said upper conduit holding members being attached to said frame;

c. at least one normally curved elongated resilient member connecting said upper and lower conduit holding members;

d. means carried by said frame for restraining said resilient member in a straightened condition whereby said upper and lower holding members are axially aligned; and e. means operable from the surface of said bore hole for releasing said restraining means whereby said resilient member tends to resume its normally curved position displacing said lower conduit holding member relative to said upper conduit holding member whereby said conduit and rotary bit are deflected in the direction of such displacement.

2. The guide means of claim 1 in which there are at least two upper conduit holding members attached to said frame.

3. The guide means of claim 1 in which the lower conduit holding member is a steel ring.

4. The guide means of claim 3 in which there are a plurality of roller bearing means around the inner periphery of the steel ring to facilitate relative movement between the ring and the conduit.

5. The guide means of claim 1 in which the boring means is a rotary drilling bit and in which there are a plurality of normally curved resilient members.

6. The guide means of claim 1 in which the frame is an inverted wye and wherein the upper conduit holding members are attached to the depending legs of the wye.

7. Guide means for changing the direction of advance in a bore hole of a boring tool comprising a rotary bit affixed to a flexible conduit for conducting drilling fluid thereto comprising:

a. a hollow steel frame in the form of an inverted wye having an upper neck portion and two depending leg portions;

b. spaced upper and lower conduit holding members, said upper conduit holding members being attached to the depending legs of said wye frame;

c. at least one normally curved elongated resilient member connecting said upper and lower conduit holding members;

d. control lines carried within said frame;

e. openings near the base of the leg portions of said wye frame through which said control lines emerge for fastening to said lower conduit holding members;

f. means carried within the upper neck portion of said frame for controlling the position of the control lines; and g. means operable from the surface of said bore hole for controlling the operation of the control line positioning means.

8. A process for changing the direction of advance in a bore hole of a boring means affixed to a flexible conduit for conducting drilling fluid thereto comprising:

a. at the surface, affixing a plurality of spaced conduit holding means around said conduit, one of said conduit holding means being adjacent said boring means, said conduit holding means being connected by at least one normally curved resilient member;

b. restraining said resilient member to a straightened condition whereby said spaced conduit holding means are axially aligned;

c. lowering said conduit and said conduit holding means in the restrained position into the well bore until the boring tool is positioned at the point therein where it is desired to change the direction of advance of the boring tool;

d. from the surface releasing the restraining means to the extent required to allow the resilient member to resume at least in part its normally curved position whereby said lower conduit holding member is displaced relative to said upper conduit holding member and the boring means is urged in the direction of such displacement; and e. rotating said boring means to extend said bore hole in the direction of such displacement.

9. The process of claim 8 wherein after said boring means has advanced to the extent desired in step (e) of claim 8 the further steps of:

a. withdrawing said conduit and said boring means to the original lowered position in step (c) of claim 8;

b. from the surface tightening the restraining means to cause said resilient member to axially align the spaced conduit holding members;

c. rotating said resilient member and conduit holding members to reorient the direction toward which said resilient member will tend to displace said conduit holding members relative to each other;

d. from the surface releasing the restraining means to again allow the resilient member to axially displace the lower conduit holding member relative to the upper conduit holding member whereby said boring means is urged into the reoriented direction; and e. rotating said boring means to extend said bore in said reoriented direction.

10. The process of claim 8 wherein after said boring means has advanced to the extent desired in step (e) of claim 8 the further steps of:

a. withdrawing said conduit and boring means to the original lowered position in step (c) of claim 8;

b. from the surface, tightening the restraining means to cause said resilient member to axially align the spaced conduit holding members;

c. moving said conduit and boring means to a vertically displaced position in said well bore;

d. from the surface releasing the restraining means to again allow the resilient member to axially displace the lower conduit holding member relative to the upper conduit holding member whereby said boring means is again urged into the desired direction of advance at a different level in the bore hole; and e. rotating said boring means to form another extension to said bore hole at said different level.

* * * * *